United States Patent [19]

Markus

[11] 4,452,014

[45] Jun. 5, 1984

[54] DEVICE FOR OPERATING A SLIDING DOOR

[75] Inventor: Jan J. G. Markus, Krimpen Aan Den Ijssel, Netherlands

[73] Assignee: Markus Hermetische Deuren B.V., Krimpen Aan Den Ijssel, Netherlands

[21] Appl. No.: 445,418

[22] Filed: Nov. 30, 1982

[30] Foreign Application Priority Data

Dec. 28, 1981 [NL] Netherlands ..... 8105876

[51] Int. Cl.[3] ..... E05F 11/00; E05F 11/38

[52] U.S. Cl. ..... 49/360; 49/210; 49/409

[58] Field of Search ..... 49/360, 28, 210, 209, 49/409, 410, 235

[56] References Cited

U.S. PATENT DOCUMENTS

| | | | |
|---|---|---|---|
| 1,324,587 | 12/1919 | Elliott | 49/360 |
| 3,276,166 | 10/1966 | Markus | 49/410 |
| 3,344,556 | 10/1967 | Edwards | 49/360 |
| 3,473,266 | 10/1969 | Miller | 49/409 X |
| 3,611,637 | 10/1971 | Saino | 49/410 X |
| 3,625,328 | 12/1971 | Carli | 49/360 X |
| 4,313,281 | 2/1982 | Richmond | 49/360 X |
| 4,404,770 | 9/1983 | Markus | 49/409 X |

*Primary Examiner*—Philip C. Kannan

*Attorney, Agent, or Firm*—Karl W. Flocks; Sheridan Neimark

[57] ABSTRACT

Device for operating a sliding door comprising an endless chain guided over at least two wheels in a plane parallel to the plane of the door, said chain being provided with at least one catch which can co-operate with at least one abutment connected to the door for opening and/or closing said door. The guiding wheels of the chain being positioned such that the direction of movement of the catch has a relatively large vertical component at the beginning of the movement of the door.

7 Claims, 3 Drawing Figures

DEVICE FOR OPERATING A SLIDING DOOR

The invention relates to a device for operating a sliding door, in particular for opening it.

Known operating devices comprise e.g. pneumatic or hydraulic motors, the cylinder of which can be fixed to the door-frame and the piston rod to the sliding door. Because of the distance over which such a sliding door must travel, the motor used therefore will have to have a considerable length. Furthermore, a pressurized fluid must be supplied to the motor through a line system and this line system will have to comprise valves for adjusting the supply of the medium to the motor.

For an automatic operation of the door, use will be made in most cases of an electric activation of the valves concerned, so that besides pressure fluid lines also electric lines must be available in the vicinity of the door to be operated.

It will be obvious that the use of pneumatic or hydraulic motors meets objections when in a building the sliding doors to be operated are situated at a large distance from one another and the pressure fluid concerned is used only for operating the sliding doors, so that for that purpose alone a compressor or pumping device must be available.

From U.S. Pat. No. 3,276,166 a sliding door is known, which is suspended from rollers which are supported in such a way that because of its weight the sliding door moves slightly downwards and towards the wall in which the opening to be closed is provided during the last stage of its closing movement. In such a case the sliding door must be lifted slightly when being opened, so that the above-described pressure fluid motor will have to exert a considerable force in the initial stage of the opening of the door. Therefore the pressure fluid motor must have such dimensions that it can supply this force. Furthermore it must be assured that a too fast movement of the door is prevented after it has been lifted up slightly and the rollers are travelling over the almost entirely horizontal parts of the guiding rail. For the latter movement only a minor force is necessary so that for this travel the motor will be strongly oversized.

It is the purpose of the invention to provide a device for operating a sliding door, with which the above-described drawbacks do not occur to a lesser extent.

According to the invention this is achieved in that the device comprises an endless chain or similar means guided over at least two wheels, which chain is provided in a plane parallel to the plane of the door and which chain is provided with at least one catch which can come to lie against the abutment connected to the door in such a way that when the catch lies against the abutment, the door is slid towards the described position when the chain travels, at least one of said guiding wheels being provided in such a way in respect of the abutment of the door to be operated, that the direction of movement of the catch of the chain has a relatively large vertical component at the beginning of the movement of the door, which component decreases until almost zero once the door has been brought into movement.

So the guiding wheel of the chain will be positioned and driven in such a way that the catch connected to the chain will engage the abutment of the door just after the catch has passed the point which is situated at the same height as the centre of the guiding wheel. At that moment the catch travels almost vertically towards the door and during the further movement of the chain the horizontal speed component will increase continuously and the vertical speed component will decrease. Thus the door will be brought into movement very gradually, so that the traction force to be exerted on the chain can be limited, so that also the motor used for driving the chain can have a limited power.

This is of great importance when the device is used with a sliding door which, when being opened, must make a slightly upwards movement, as described above, for which movement a great force is necessary, whereas afterwards only the rolling friction of the sliding door will have to be overcome.

Preferably at least one of the chain wheels will be driven by an electric motor. In that case only an electric line needs to be installed towards the place of the door, whereas in most cases such lines are already available anyhow because of the illumination of the room concerned.

The automatic switching on and off of the operating device can also take place in the known simple way by means of mechanically or otherwise activated switches, which can directly switch on and off the motor for driving the chain.

According to a preferred embodiment, the chain can always travel in the same direction and the catch of the chain will be freed from the abutment when the door has been brought to its other, in particular opened, position by a suitable positioning of the other guiding wheel, whereas the returning movement of the door towards its initial position takes place by means of a spring, a weight or in a similar way.

The device might then be such that e.g. the door is automatically opened when a person approaches it, because the motor driving the chain is switched on, whereas after the opening of the door the motor is switched off, e.g. by means of an end switch and the door returns automatically towards its closed position. This results in a very simple electric circuit, whereas it is also an advantage that if a spring is used for closing the door, no safety device is necessary, as the door can be held back easily if necessary.

By providing an electric switch close to the door, it is also possible to stop the motor just before the catch of the chain is freed from the abutment, just before the door is entirely opened, so that then the door will be held in its almost opened position. In this case of course it is required that the chain will not be moved in the opposite direction under the influence of the spring or other force exerted on the door, which will try to close the door.

It is advantageous to provide the chain with two catches, which are provided at the maximum distance from one another. When the door has been opened by the one catch and the motor for driving the chain is stopped, the other catch will be approximately in that position in which it can open the door again after the door has returned to its closed position under the influence of the spring force or similar force or also during the return of the door towards its closed position.

According to another embodiment of the invention, the door can be provided with two abutments which are provided at such a distance from one another, that the catch connected to the chain can be accomodated between them, whereas the chain can be driven into both directions. In this case it is possible to use the chain for moving the sliding door in both directions, so that no springs or such means have to be used.

According to a further embodiment of the invention, the motor will drive the guiding wheel of the chain or similar means by means of a friction coupling, so that the motor will not be overloaded if the door when moving hits obstacle present by chance.

This will be desirable in particular when the operating device is carried out in such a way, that the door is also brought towards the closed position by means of the chain.

Instead of providing a friction coupling or also in addition thereto, the abutment connected to the door can be held in its active position with respect to the door by means of spring force and can be moved out of the path of the catch of the chain by overcoming said spring force.

In this case the abutment e.g. can be mounted in a pivoting way, so that when the door is blocked in an intermediate position, the catch of the chain can travel on and cause the abutment to pivot until it is outside the path of the catch. After the catch has passed, the abutment can return to its original position.

According to another embodiment, the abutment connected to the door can be held in its active position with respect to the door by means of spring force and operate a switch provided near the abutment when the load exerted on the abutment exceeds a certain value, the switch assuring the stopping of the driving motor.

In this way it is possible to switch off the driving motor directly when the door is blocked for one reason or another during its travel, whereas the door can travel on again when the obstacle has been removed. In this case, however, it is necessary to install electric lines to the travelling door.

It will be obvious to the expert that there are many other possibilities, which need not be described in detail here.

The invention will now be explained by means of an embodiment, shown in the drawing, in which.

Figure 1:
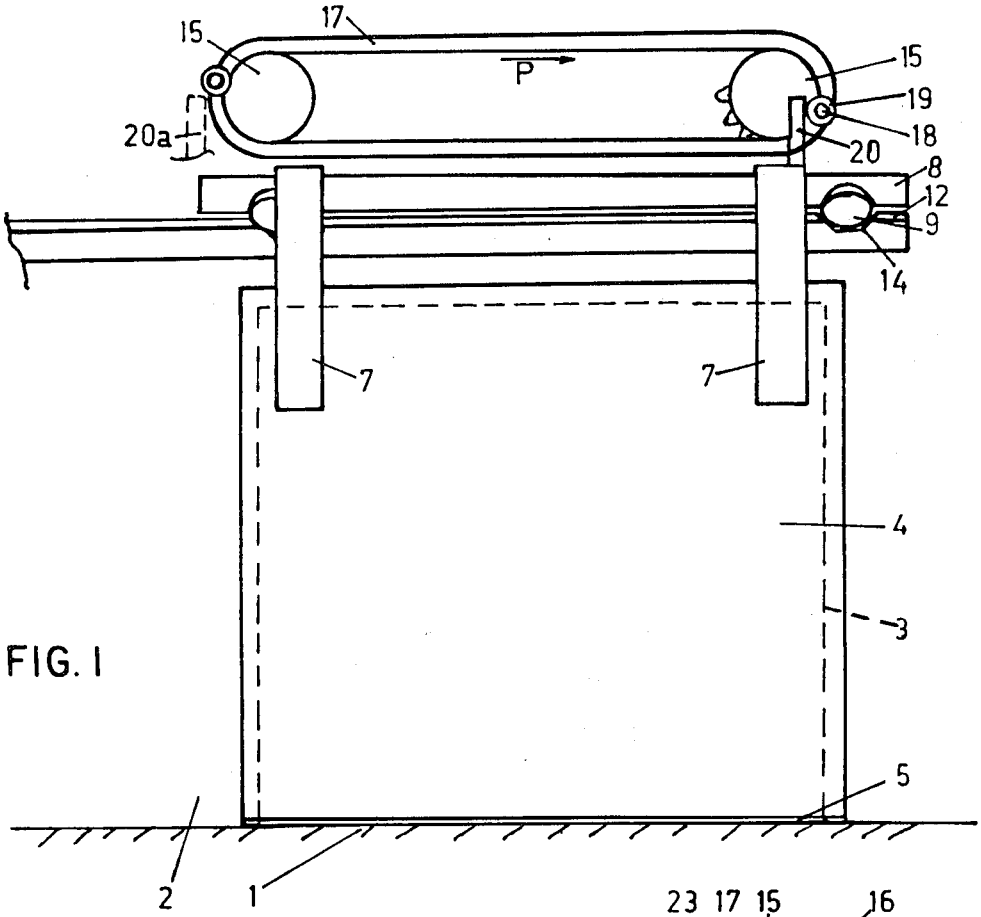
FIG. 1 shows a view of a sliding door with an operating device according to the invention.

In the drawing a floor is indicated by the reference number 1, on which stands a wall 2, which is provided with an opening 3, which is closed by the sliding door 4.

The sliding door is shown in the closed position, in which it lies in a sealing manner against the floor 1 by means of the sealing 5 and against the wall 2 by means of the sealing 6.

Figure 2:
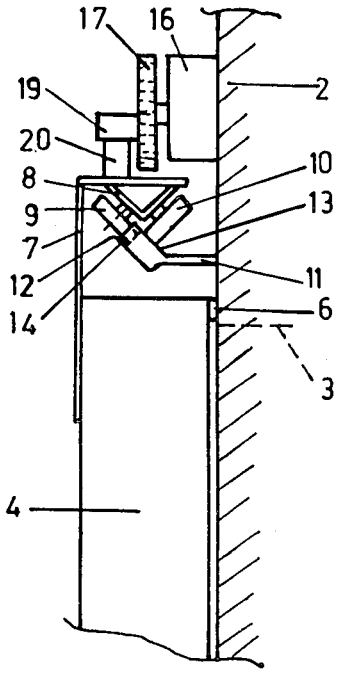
FIG. 2 shows a lateral view of a part of the whole of FIG. 1.

In the embodiment according to FIGS. 1 and 2, the door 4 is provided at the upper side with two squarely bent supports 7, carrying an angle section 8, on which a first pair of rollers 9 and a second pair of rollers 10 are mounted. The rollers 9 and 10 are provided in planes, which constitute an angle of almost 90° with one another.

For supporting the rollers 9 and 10, a supporting rail 11 is mounted on the wall 2, with a supporting surface 12 and a guiding surface 13 for supporting the rollers 9 and 10, respectively.

As appears in particular from FIG. 1, in the supporting surface 12 two recesses 14 are provided in which the rollers 9 lie when the door is in its closed position, as shown in the drawing.

When the sliding door is opened, the rollers 9 must first be freed from the recesses 14, for which purpose the door, seen from the position shown in FIG. 2, must travel slightly upwards and towards the left, so that the door is completely freed from the wall 2. It is obvious that, in order to bring the door into movement, a considerable force must be exerted to it because the whole weight of the door must be lifted slightly.

In order to open the door, a device has been mounted above it, comprising two chain wheels 15, at least one of which is driven by means of a motor with reduction gear 16. Over the chain wheels 15 runs a chain 17, which at two places at a maximum distance from one another is provided with a protruding pin 18, on which a roller 19 is rotatably mounted.

The roller 19 serves as a catch and can co-operate with an abutment 20, which is mounted on one of the supports 7, which are connected to the door 4.

In the drawing the position is shown which the chain 17 can take before the door 4 has to be opened. The roller 19 is then just near the abutment 20. When the motor 16 now is switched on, in such a way that the chain travels in the direction of the arrow P of FIG. 1, the roller 19 will first make a mainly vertical, downward movement and only a very small lateral movement, so that the door 4 will travel very gradually towards the left, as seen in FIG. 1. Thus the door 4 will travel initially at a very slow speed, so that the rollers 9 will be pushed slowly upwards out of the recesses 14 and will take the door along in the upwards direction. After the door has been taken upwards, the rollers 9 run over the flat part of the supporting surface 12 of the rail 11, so that only the rolling friction of the door has to be overcome. When the roller 19 of the chain 17 travels along its curved path, the horizontal speed of the roller 19 gradually increases, so that also the travelling speed of the door 4 will increase gradually to reach its maximum value when the roller 19 has turned over approximately 80° with respect to the rotation axis of the chain wheel 15 and begins its horizontal movement.

Figure 3:
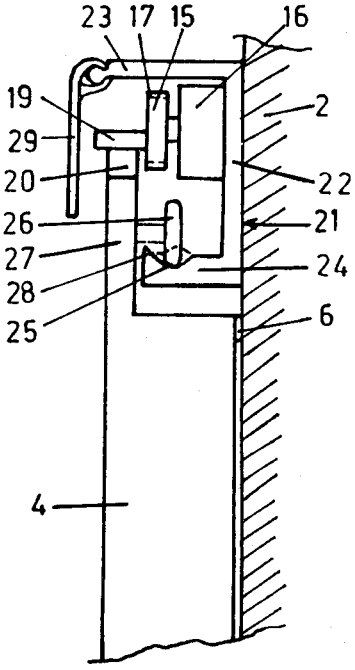
FIG. 3 shows a lateral view in accordance with FIG. 2, but of a slightly different embodiment of the sliding door.

The door 4 will be slid by the roller 19 until the roller 19 is freed from the abutment 20, which position is indicated as 20*a* by means of interrupted lines. The roller 19 is then free from the abutment and the motor 16 can be stopped, in which position the other roller 19 will take the position as shown at the right in FIG. 1. By means of a spring or weight, not shown, the door 4 can be pulled back towards its closed position and subsequently be opened again or also it can be stopped during this closing movement when the motor 16 is switched on again. FIG. 3 shows a slightly different embodiment of the device according to FIGS. 1 and 2. In FIG. 3, corresponding parts are referred to by the same reference numbers.

The reduction gear 16 with the chain wheels 15 and the chain 17 now are mounted within a section 21, which is mounted to the wall 2 by means of the vertical section portion 22. Furthermore the section 21 has an upper horizontal section portion 23 and a lower horizontal section portion 24. This horizontal section portion 24 is provided with two recesses 25, in which the rollers 26 can come to lie, which are connected to an upwardly extending edge 27 of the door 4. The interrupted line 28 indicates the further path of the upper surface of the horizontal section portion 24. It is obvious that the further path 28 is such that when the rollers 26 are freed from the recesses 25, the door 4 is brought slightly upwards and outwards in the same way as is the case with the embodiment according to FIGS. 1 and 2.

To the front edge of the horizontal section portion 23 a cover 29 can be connected so that the various parts of the device are hidden from view.

As said above safety devices might be used, e.g. a friction coupling between the driving motor 16 and the chain wheel 15 and/or an abutment 20 which can be pushed away against a spring force. In the latter case the abutment e.g. can be mounted on a downwardly projecting arm, which is pivot-mounted on the support 7 and is held in its correct position by means of a spring. This arm can also be used to bring the abutment manually outside the path of the roller 19, in which position the arm can be locked temporarily, so that the functioning of the motor 16 and of the parts connected therewith can be inspected, without the door having to stay in the opened position.

It is also possible to mount a switch near the pivoting abutment, which switch immediately switches off the motor when such a force is exterted on the abutment that it pivots somewhat against the action of the spring.

Furthermore it is possible to provide the door with two abutments between which the roller 19 is accomodated so that the door remains continuously coupled to the chain and the chain must travel in both directions for opening and closing the door. In that case, of course, the chain needs to have only one single roller 19, but the electric circuit is more complicated and the motor must be rotatable in two directions.

All these possibilities will be obvious to the expert and therefore they are not shown in the drawing.

What is claimed is:

1. In a sliding door of the type wherein the door is movable from a first position toward a second position by a first lifting motion followed by a sliding motion, the improvement comprising operating means for moving the door from its first position toward its second position, said operating means including an endless chain carried by at least two guiding wheels disposed above said door in a plane parallel thereto, abutment means associated with said door, and catch means for engaging said abutment means and for urging said door from said first position toward said second position disposed on said endless chain to travel therewith; so that inital movement of said endless chain and catch means against abutment has a relatively large vertical component which gradually approaches zero as the door is urged from its first position toward its second position by said catch means.

2. The device according to claim 1, wherein said catch means initially engages said abutment at a point where said catch means is travelling substantially vertically downwards and where, with further travel of said chain, the horizontal speed component of said catch means continuously increases and the vertical speed component continuously decreases.

3. The device according to claim 1, wherein said first position is a closed position and said second position is an open position.

4. Device according to claim 1, wherein at least one of the guiding wheels is driven by an electric motor.

5. The device according to claim 4, wherein the chain always travels in the same direction and the catch means is freed from the abutment when the door is moved into its second position.

6. The device according to claim 1, wherein the chain always travels in the same direction and the catch means is freed from the abutment when the door is moved to its second position.

7. The device according to claim 6, wherein the chain includes two catch means at the maximum distance from one another.

* * * * *